United States Patent [19]

Rogo et al.

[11] 4,403,914

[45] Sep. 13, 1983

[54] VARIABLE GEOMETRY DEVICE FOR TURBOMACHINERY

[75] Inventors: Casimir Rogo, Mt. Clements; Herman N. Lenz; Michael Holbrook, both of Lambertville, all of Mich.

[73] Assignee: Teledyne Industries, Inc., Los Angeles, Calif.

[21] Appl. No.: 282,524

[22] Filed: Jul. 13, 1981

[51] Int. Cl.[3] ..... F04D 27/00

[52] U.S. Cl. ..... 415/165; 415/150

[58] Field of Search ..... 415/148, 150, 151, 157, 415/158, 165, 211

[56] References Cited

U.S. PATENT DOCUMENTS

| | | | |
|---|---|---|---|
| 2,739,782 | 3/1956 | White . | |
| 2,763,426 | 11/1956 | Erwin . | |
| 2,846,185 | 8/1958 | Widmer | 415/150 |
| 3,079,127 | 2/1963 | Rowlett et al. | 415/165 X |
| 3,245,399 | 4/1966 | Lawson | 415/158 UX |
| 3,375,120 | 1/1968 | Jassniker . | |
| 3,407,740 | 10/1968 | Samerdyke . | |
| 3,478,955 | 11/1969 | Kunderman . | |
| 3,489,391 | 1/1970 | Kanger et al. | 415/157 |
| 3,667,860 | 6/1972 | Endress et al. | 415/158 X |
| 3,749,513 | 7/1973 | Chute | 415/158 X |
| 3,829,237 | 8/1974 | Chestnutt | 415/181 |
| 3,887,295 | 6/1975 | Yu | 415/116 |
| 3,972,642 | 8/1976 | Fricke et al. | 415/158 X |
| 3,975,911 | 8/1976 | Morgulis et al. | 60/602 |
| 3,994,620 | 11/1976 | Spraker, Jr. et al. | 415/145 |
| 4,149,826 | 4/1979 | Torstenfelt | 415/127 |

FOREIGN PATENT DOCUMENTS

| | | | |
|---|---|---|---|
| 1011671 | 7/1957 | Fed. Rep. of Germany | 415/158 |
| 1084552 | 1/1955 | France | 415/158 |
| 54-133613 | 10/1979 | Japan | 415/211 |

*Primary Examiner*—Harvey O. Hornsby
*Assistant Examiner*—Joseph M. Pitko
*Attorney, Agent, or Firm*—Gifford, VanOphem, Sheridan & Sprinkle

[57] ABSTRACT

A variable geometry device is provided for use in a turbine engine having a support housing, a rotor contained within the support housing and a pair of spaced walls forming an annular and radially extending passageway open at one end to the rotor. An annular recessed channel is formed in one of the support housing walls while a ring is mounted within the channel and movable between a retracted position in which the ring is nested within the channel and an extended position in which the ring protrudes transversely into and variably restricts the passageway so that the restriction of the fluid passageway is substantially proportional to the transverse position of the ring. A plurality of circumferentially spaced vanes are secured to the ring and these vanes extend transversely across the fluid passageway and are slidably received within slots formed in the other support housing wall. In addition, the face of the ring open to the fluid passageway is contoured by meridional constriction for maximum engine efficiency.

11 Claims, 5 Drawing Figures

VARIABLE GEOMETRY DEVICE FOR TURBOMACHINERY

BACKGROUND OF THE INVENTION

I. Field of the Invention

The present invention relates generally to variable geometry devices employed in turbine engines and, more particularly, to such a device used in either a compressor diffuser or turbine nozzle passageway.

II. Description of the Prior Art

A conventional turbine engine includes a support housing, a compressor rotatably mounted within the support housing and having an outlet open to a combustion chamber through a diffuser passageway. In previously known turbine engines, the diffuser passageway is generally annular in shape having its inner end open to the compressor outlet so that the compressed air flow through the diffuser passageway is generally radially outwardly. In addition, many of the previously known turbine engines include diffuser vanes extending across the diffuser passageway to aerodynamically shape and control the flow of compressed air from the compressor and to the combustion chamber.

Following the combustion of the fuel and compressed air within the combustion chamber, the exhaust gases from the combustion chamber exhaust through a nozzle passageway and ultimately through one or more turbine stages. The nozzle passageway, like the diffuser passageway, is annular in shape and the flow direction through the nozzle passageway is radially inwardly. A turbine nozzle comprising a plurality of circumferentially spaced nozzle vanes is disposed within the nozzle passageway to aerodynamically control and shape the flow of the gas stream from the combustion chamber and to the turbine stage or stages.

Many turbine engine applications require that the turbine engine be operated over a broad range of operating conditions. These different operating conditions, in turn, entail different air flow and pressure delivery requirements through the diffuser passageway as well as different gas stream flow requirements through the nozzle passageway in order to obtain maximum engine efficiency. Moreover, it is highly desirable to maintain high turbine engine efficiency in all engine operating conditions in order to minimize surge, cavitation, and other engine instabilities as well as maximizing fuel economy.

One previously known way of controlling the flow through either the diffuser or outlet passageway is to use variable geometry engine components. In one type of previously known variable geometry device, the diffuser and/or nozzle vanes are pivotally mounted to the turbine engine support housing and the angle or pitch of these vanes is then varied to vary the aerodynamic geometry.

These previously pivoted vanes, however, have not proven wholly satisfactory in use. One disadvantage of these previously known variable geometry devices results from the leakage losses from either the compressed air or gas stream. These leakage losses are further amplified due to the relatively large openings necessary to pivotally mount the vanes to the support housing. Such large openings are required to compensate for thermal distortion and relative thermal expansion between the vanes and the support housing. This thermal expansion is particularly acute in the outlet nozzle region of the turbine engine.

A still further disadvantage of the previously known pivoted vane variable geometry devices is that such vanes are designated to minimize turbulence of the air flow or gas stream at a predetermined angle or pitch. Consequently, when the angle or pitch of the vane is varied, the turbulence of the air flow or gas stream necessarily increases. Such turbulence is undesirable since it decreases the overall efficiency of the turbine engine.

SUMMARY OF THE PRESENT INVENTION

The present invention provides a variable geometry device for use in either the nozzle passageway or diffuser passageway of a turbine engine which overcomes the abovementioned disadvantages of the previously known variable geometry devices.

In brief, the present invention comprises a turbine engine having a support housing with a pair of spaced walls which form a fluid passageway therebetween. The spaced walls extend generally radially so that the passageway is annular in shape. In addition, the direction of fluid flow through the passageway is substantially radial in direction and the fluid passageway can be either the diffuser passageway or nozzle passageway for the turbine engine.

An annular recessed channel is formed around the entire circumfery of one of the support housing walls. A ring is positioned within the channel while means are attached to this ring for variably moving the ring transversely across the passageway between a retracted position and an extended position. In its retracted position, the ring is nested within the channel while in its extended position, the ring protrudes into and restricts the passageway.

In the preferred form of the invention, a recessed channel is also formed in the other support housing wall facing and in registry with the recessed channel on the first support housing wall. An annular member is positioned and stationarily secured within this second channel. The annular member includes a plurality of slots which register with a like number of vanes secured to the movable ring so that as the ring is moved between its extended and its retracted position, the vanes slide through the annular member slots. In addition, an annular piston ring is secured to the free end of each vane and the piston member is slidably received within a cavity in the annular member. The piston serves to support the free ends of the vanes within the annular member and eliminate vibration and/or deflection of the vanes.

An important feature of the present invention is that the side of the ring facing the passageway is contoured for maximum engine efficiency by meridional constriction. This contoured side of the ring, furthermore, variably restricts the fluid passageway by an amount which is substantially proportional to the transverse position of the ring with respect to the passageway.

BRIEF DESCRIPTION OF THE DRAWING

A better understanding of the present invention will be had upon reference to the following description when read in conjunction with the accompanying drawing, wherein like reference characters refer to like parts throughout the several views, and in which.

DETAILED DESCRIPTIONS OF PREFERRED EMBODIMENTS OF THE PRESENT INVENTION

Figure 1:
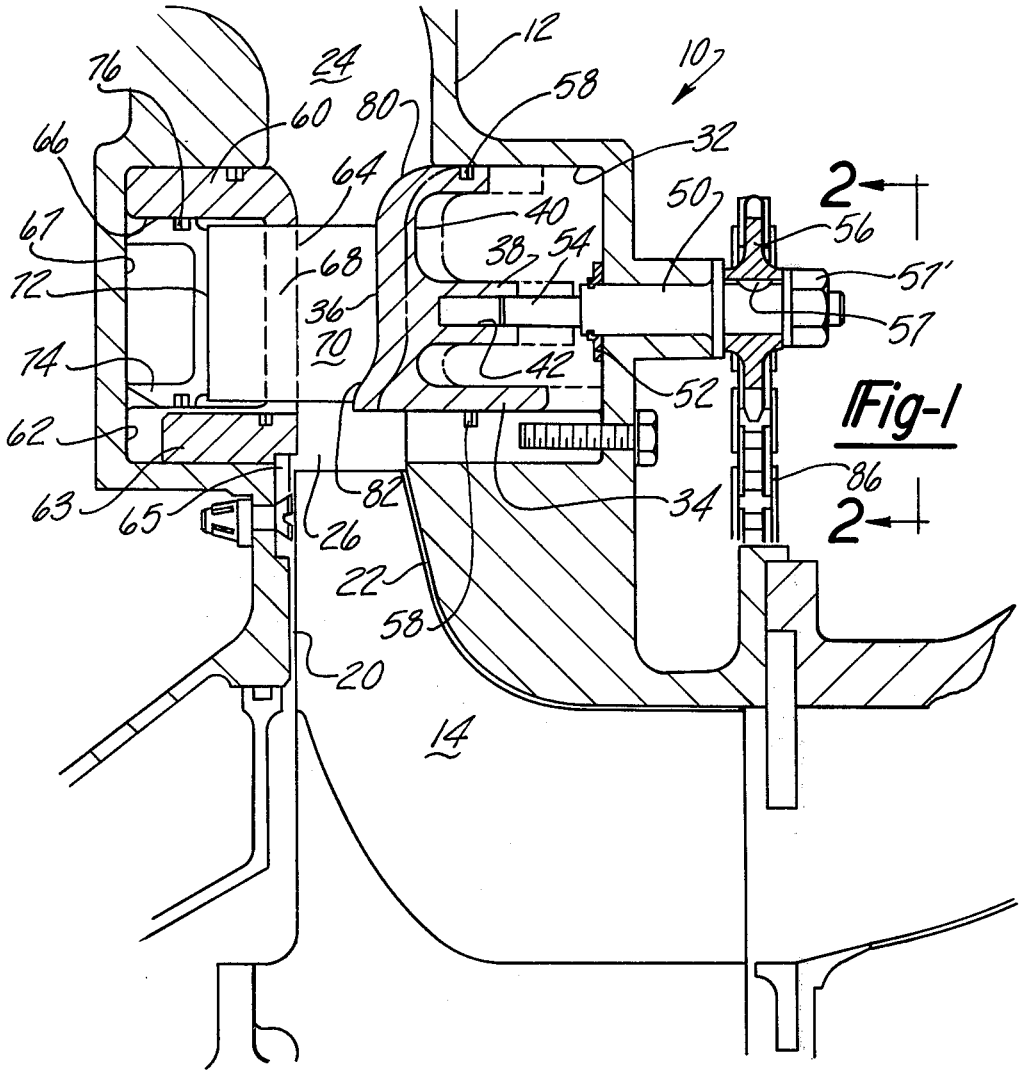
FIG. 1 is a fragmentary sectional view illustrating a preferred embodiment of the variable geometry device of the present invention.
Figure 2:
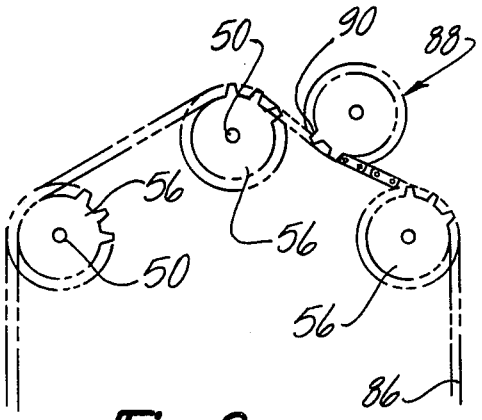
FIG. 2 is a fragmentary and partial diagrammatical view taken substantially along line 2—2 in FIG. 1.

With reference first to FIGS. 1 and 2, a portion of a turbine engine 10 is thereshown and comprises a support housing 12 in which a rotor 14 is rotatably mounted. As shown in FIGS. 1 and 2, the rotor 14 is the first turbine stage of the turbine engine 10.

The support housing 12 includes a first annular wall 20 and a second annular wall 22 which is spaced apart from the first wall and the walls 20 and 22, together, form an annular passageway 24 therebetween. The inner end 26 of the passageway 24 is open to the rotor 14 while the outermost end of the passageway 24 is open to the combustion chamber (not shown) of the engine 10. In the well known fashion, the fluid or gas stream flow through the passageway 24 flows from the combustion chamber, radially inwardly through the passageway 24 and to the rotor 14.

An annular recessed channel 32 having a generally rectangular cross sectional shape is formed around the entire circumfery of the support housing wall 22. A ring 34 having a front face 36 is positioned within the channel 32 so that the ring also extends around the entire passageway 24. The ring 34 is of a rigid construction and is preferably formed by casting.

A plurality of circumferentially spaced pins 38 are secured to or formed as a part of the ring 34 so that the pins 38 extend laterally outwardly from the side 40 of the ring 34 opposite from its side 36. Each pin 38 includes an internally threaded axial bore 42.

A plurality of circumferentially spaced shafts 50 are rotatably mounted to the support housing 12 at the base or outermost side of the channel 32 so that each shaft 50 registers with one of the pins 38. In addition, each shaft 50 is constrained against axial movement by a retainer 52 and includes an externally threaded portion 54 which registers with and threadably engages the threaded bore 42 on each pin 38. A pinion 56 is secured by a key 57 and nut 57' to the other end of each shaft 50 so that rotation of the pinion 56 rotatably drives its attached shaft 50. Simultaneously, due to the threaded connection between the shaft portion 54 and the threaded bore 42, the ring 34 is displaced transversely across the passageway 24 in dependence upon the direction and amount of rotation of the shaft 50. Thus, the ring 34 is movable between its retracted position, illustrated in phantom line in FIG. 1, in which the ring 34 is nested within the channel 32 and its extended position, illustrated in solid line in FIG. 1, in which the ring 34 protrudes into the passageway 24. Fluid seals 58 between the ring 34 and the support housing 12 around the channel 32 fluidly seal the ring 34 to the channel 32.

In the preferred form of the invention, an annular ring 60 is positioned within a rectangular cross section channel 62 formed in the support housing side wall 20 opposite from the side wall 22 so that the annular ring 60 registers with and faces the ring 34. Unlike the ring 34, however, the annular ring 60 is secured within the recess 62 by a retainer ring 63 and tab 65 and thus is not movable with respect to the support housing 12. The annular ring 60 is generally U-shaped in cross section having its base or side 64 generally aligned with the support housing wall 20 and forming a cavity 66 defined between the annular ring base 64 and the base 67 of the channel 62.

A plurality of circumferentially spaced slots 68 (only one shown) are formed through the base 64 of the annular ring 60. In addition, a plurality of vanes 70 are secured to the movable ring 34 so that the vanes extend transversely across the passageway 24 and are slidably received through the slots 68. Although, only a single vane 70 is shown, it will be understood that one slot 68 is provided in the annular ring 60 for each vane 70 secured to the movable ring 34. Furthermore, the vanes 70 are sufficiently elongated so that an end 72 of each vane 70 is positioned within the annulus cavity 66 even when the ring 34 is in its fully retracted position.

A piston 74 is attached to or formed as a part of the vane ends 72 and the outer periphery of the piston 74 slidably engages the walls of the cavity 66 while seals 76 are preferably provided between the piston member 74 and cavity 66. The piston member 74, which moves in unison with the ring 34, adds rigidity to the vanes 70 and prevents deflection or possible vibration of the vanes 70 during operation of the engine 10.

An important feature of the present invention is that the face 36 of the ring 34 which faces the passageway 24 as well as the side of the base 64 of the annular ring 60 are contoured by meridional constriction so that secondary flows, turbulences and the resultant loss of the engine efficiency during fluid flow through the passageway 24 is reduced regardless of the transverse position of the movable ring 34. As is best shown in FIG. 1, the contoured side 36 of the ring 34 is tapered inwardly towards the recess 32 at its upstream end 80 and, conversely, protrudes outwardly into the passageway 24 at its downstream end 82.

With reference still to FIGS. 1 and 2, a chain 86 extends around and meshes with each pinion 56 while a reversible motor 88 has its output pinion 90 in mesh with the chain 86. Thus, actuation of the motor 88 transversely moves the ring 34 across the passageway 24 in dependence upon the direction of rotation of the motor 88. The plural pinions 56 each of which threadably engages one pin bore 42 on the movable ring 34, ensures that the entire ring 34 transversely moves with respect to the passageway 24 without cocking of the ring 34.

In operation, the motor 88 is actuated to variably displace the movable ring 34 between its retracted position, in which the ring 34 is nested within the channel 32, and its extended position in which the ring 34 protrudes outwardly into and restricts the passageway 24. Furthermore, the contoured face 36 of the movable ring 34 ensures that the turbulence of the radial flow through the passageway 24 is minimized even though restricted.

Figure 3:
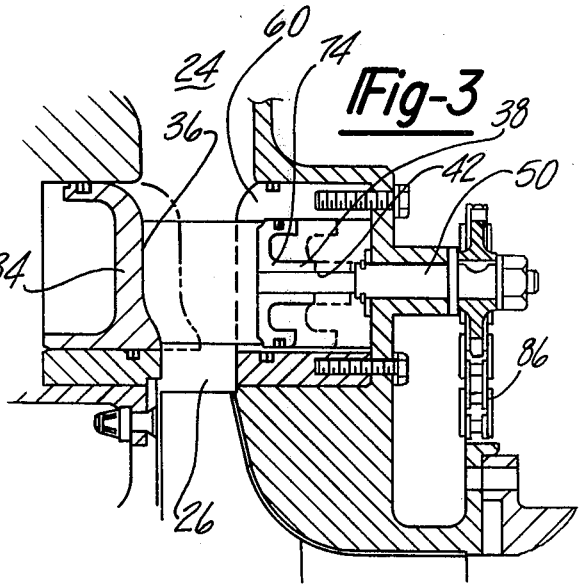
FIG. 3 is a fragmentary sectional view similar to FIG. 1 but showing a modification thereof.

With reference now particularly to FIG. 3, a modification of the variable geometry device illustrated in FIG. 1 is thereshown. Moreover, for the sake of brevity, only the differences in the modification shown in FIG. 3 from that shown in FIG. 1 will be described.

With reference then to FIG. 3, the relative position of the movable ring 34 with its contoured face 36 and the stationary annulus 60 have been reversed from that shown in FIG. 1. In addition, the actuating pin 38 with its internally threaded bore 42 extends laterally outwardly from the piston 74 rather than the movable ring 34. The threaded portions 54 on the shaft 50 then threadably engage the threaded bores 42 so that rotation of the shaft 50 transversely moves the ring 34 from its retracted position, shown in solid line and its extended position, shown in phantom line.

Figure 4:
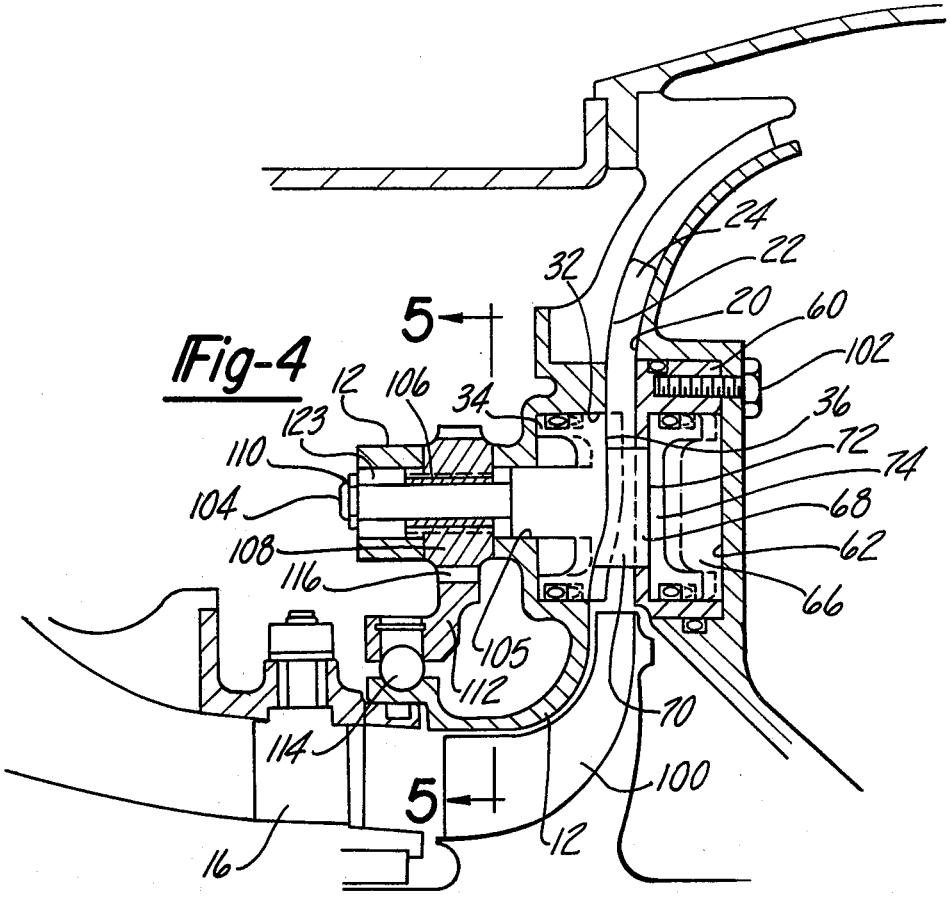
FIG. 4 is a fragmentary sectional view illustrating a further preferred embodiment of the variable geometry device of the present invention.
Figure 5:
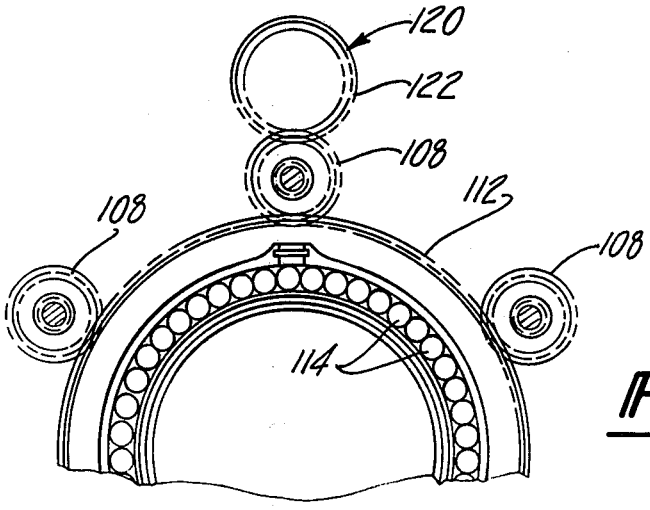
FIG. 5 is fragmentary and partial diagrammatic view taken substantially along line 5—5 in FIG. 4.

With reference now to FIGS. 4 and 5, a still further modification of the variable geometry device according to the present invention is thereshown. Unlike the previously described embodiments of the present invention, the support housing walls 20 and 22 form a diffuser passageway from a compressor impeller 100 and to the combustion chamber (not shown). Consequently, the flow through the passageway 24 is reversed, i.e., radially outwardly, from the flow direction of the FIG. 1–FIG. 3 embodiments of the invention.

With reference then to FIGS. 4 and 5, the movable ring 34 with its contoured face 36 is transversely slidably mounted within the recessed channel 32 in the support housing wall 22. Likewise, as before, the stationary annular ring 60 is mounted within an annular recessed channel 62 on the other support housing wall 20 by any appropriate means, such as a bolt 102. The circumferentially spaced vanes 70 are secured to the movable ring 34, extend transversely across the passageway 24, through the slots 68 and one piston 74 is secured to the end 72 of each vane 70 within the annulus cavity 66. Thus, as before, the transverse displacement of the movable ring 34 across the passageway 24 variably restricts the passageway 24 while the piston 74 supports and rigidifies the free ends of the vanes 70.

The embodiment of the present invention shown in FIGS. 4 and 5 further differs from the embodiments shown in FIGS. 1–3 in the actuating means for laterally or transversely displacing the ring 34 across the passageway 24. More specifically, a plurality of circumferentially spaced pins 104 are secured to or formed as a part of the movable ring 34 and these pins 104 extend transversely outwardly from the side of the movable ring 34 opposite its contoured face 36 and through registering openings 105 in the support housing wall 22. Each pin 104 includes an externally threaded portion 106 along a midpoint of its length. In addition, these pins 104 are free to axially slide through the bores 105 and, in doing so, transversely displace the ring 34 with its attached vanes 70 and its attached piston 74.

In order to control the axial position of the pins 104, and thus the ring 34, an internally threaded pinion 108 is threadably attached to a threaded bushing 106 on each pin 104 and each pinion 108 is axially constrained with respect to the support housing 12 by a bearing 123 and a retainer 110.

A gear ring 112 (FIGS. 4 and 5) is rotatably mounted to the support housing 12 by a ball bearing assembly 114 so that the gear ring 112 rotates concentrically around the support housing 12. In addition, the teeth 116 of the gear ring 112 mesh with the inner radial side of each pinion 108. A motor 120 is also contained within the housing 12 and has an output gear 122 which meshes with one of the pinions 108. The motor 120 is a reversible motor of any conventional construction, for example, an electric or hydraulic motor.

In operation, the actuation of the motor 120 rotatably drives all of the pinions 108 in unison with each other via the gear ring 112. Simultaneously, the motor transversely displaces the ring 34 due to the threaded connection between the pinions 108 and the pin threaded bushing 106. As before, the provision of the plurality of circumferentially spaced pinions 108 prevents against any possible cocking of the ring 34 during its movement.

A unique feature of the variable geometry device of the invention when used in a centrifugal compressor is that the side wall actuation varies the flow capacity of the compressor in an efficient manner. Meridional contouring is employed on the movable side wall to maximize the performance of the compressor. In the closed diffuser position a plenum chamber 66 is formed between the vane support piston 74 and the base of the channel 62. The plenum chamber 66 is vented to the vaned diffuser space between walls 20 and 22 by the clearance space between the vanes 70 and annular ring 60. Venting of the mainstream flow to this chamber 60 along the diffuser vane end wall 60 tends to stabilize flow and pressure fluctuations due to pressure gradients along the diffuser flow path. The device of the present invention will accomplish much greater changes in flow delivery and at higher performance than other devices such as a pivoted vane diffuser or actuated side wall without meridional contouring and actuated side walls with vaneless diffusers.

From the foregoing, it can be seen that the present invention provides a novel construction for varying the aerodynamic geometry of either a diffuser or nozzle passageway in a turbine engine without varying the geometry or angle of the diffuser vanes themselves. Moreover, the device of the present invention is compact in construction and virtually fail-safe in operation.

A major advantage of the present invention is that leakage losses, a major disadvantage of the previously known pivotal vane geometry devices, is virtually entirely eliminated. In addition, any leakage which does occur through the annulus vane slots 68 is simply returned to the fluid flow through the passageway 24 in the desired fashion.

An important feature of the present invention is that the side or face of the movable ring 34 which faces the passageway 24 is contoured by meridional constriction to greatly minimize any turbulence and secondary losses of the fluid flow through the passageway 24. Since the vanes 70 are of a fixed angle or geometry, all turbulences caused by varying the pitch of the vanes, as in the previously known pivoted vane variable geometry devices, is altogether eliminated. The piston 74 further supports the vanes 70 and prevents vibration or possible distortion of the vanes during operation of the engine.

Having described our invention, however, many modifications thereto will become apparent to those skilled in the art to which it pertains without deviation from the spirit of the invention as defined by the scope of the appended claims.

We claim:

1. A variable geometry device for a turbine engine comprising:

a support housing, said support housing having a pair of substantially radially extending spaced walls forming a radial flow passageway therebetween, a first recessed channel formed along one of said support housing walls, a second recessed channel formed along the other support housing wall, said channels facing and in registration with each other, a first ring mounted in said first channel and a second ring mounted in said second channel, a plurality of spaced vanes secured to and extending between said rings, means for moving said first ring transversely across said passageway between a retracted position in which said first ring is nested within said first channel and an extended position in which said first ring protrudes into and restricts said passageway; and wherein the restriction of the passageway is substantially proportional to the transverse position of said first ring and wherein said first ring has one face which face is contoured by meridional constriction to reduce turbulence and secondary losses of fluid flow through the passageway.

2. The invention as defined in claim 1 wherein said one face of said first ring protrudes into said passageway at its downstream end.

3. The invention as defined in claim 1 wherein said second ring comprises an annulus mounted within said second channel and defining a cavity, a plurality of slots formed in said annulus between said passageway and said cavity and through which said vanes extend, and said second ring futher comprising a piston secured to each vane within said cavity, said piston being slidable within said cavity and having an outer periphery which slidably engages an inner periphery of the cavity.

4. The invention as defined in claim 3 and further comprising a plurality of circumferentially spaced pins secured to and extending outwardly from each piston and through an opening in said second channel, each pin having an internally threaded axial bore and wherein said moving means comprises a plurality of threaded shafts, each threaded shaft threadably engaging one of said pin bores and means for selectively rotating said threaded shafts in synchronism.

5. The invention as defined in claim 3 and further comprising a plenum chamber formed between said piston and said other support housing wall, and means for venting said plenum chamber to said passageway.

6. The invention as defined in claim 5 wherein said vent means comprises a clearance space between said vanes and said slots and means for fluidly connecting said plenum chamber to said clearance space.

7. The invention as defined in claim 3 and further comprising means for sealing the piston to the inner periphery of its cavity.

8. The invention as defined in claim 1 and further comprising a plurality of circumferentially spaced pins secured to and extending outwardly from the other side of said first ring and through an opening in said first channel, each pin having an internally threaded axial bore and wherein said moving means comprises a plurality of threaded shafts, each threaded shaft threadably engaging one of said pin bores and means for selectively rotating said threaded shafts in synchronism.

9. The invention as defined in claim 8 and further comprising a pinion secured to each shaft and wherein said rotating means comprises a chain which drivingly connects said pinions together, and a reversible motor having an output member drivingly connected to said chain.

10. The invention as defined in claim 1 and further comprising a plurality of circumferentially spaced pins secured to and extending outwardly from the other side of said first ring and through an opening in said first channel, each pin having an external threaded portion along its length and wherein said moving means comprises a plurality of threaded members, each threaded member threadably engaging one of said pin threaded portions and means for selectively rotating said threaded members in synchronism.

11. The invention as defined in claim 11 wherein each threaded member is an internally threaded pinion and wherein said rotating means further comprises a gear ring rotatably mounted to said support housing and in mesh with each pinion, a drive gear in mesh with one of said pinions and motor means for rotatably driving said drive gear.

* * * * *